US008671591B2

(12) United States Patent
Brown

(10) Patent No.: US 8,671,591 B2
(45) Date of Patent: Mar. 18, 2014

(54) MASSAGING FOOTWEAR

(75) Inventor: Ivan E. Brown, Spirit Lake, IA (US)

(73) Assignee: Brownmed, Inc., Spirit Lake, IA (US)

( * ) Notice: Subject to any disclaimer, the term of this patent is extended or adjusted under 35 U.S.C. 154(b) by 508 days.

(21) Appl. No.: 13/031,477

(22) Filed: Feb. 21, 2011

(65) Prior Publication Data

US 2012/0210602 A1 Aug. 23, 2012

(51) Int. Cl.
*A43B 7/14* (2006.01)

(52) U.S. Cl.
USPC ..... 36/43; 36/141

(58) Field of Classification Search
USPC ..... 36/28, 29, 43, 44, 141
See application file for complete search history.

(56) References Cited

U.S. PATENT DOCUMENTS

| | | | | | |
|---|---|---|---|---|---|
| 2,400,023 | A | | 5/1946 | Potter | |
| 3,765,422 | A | * | 10/1973 | Smith | 36/153 |
| 3,922,801 | A | | 12/1975 | Zente | |
| 3,987,559 | A | | 10/1976 | Roberts | |
| 4,170,078 | A | * | 10/1979 | Moss | 36/28 |
| 4,219,945 | A | * | 9/1980 | Rudy | 36/29 |
| 4,567,677 | A | | 2/1986 | Zona | |
| 4,658,515 | A | * | 4/1987 | Oatman | 36/44 |
| 4,686,781 | A | * | 8/1987 | Bury | 36/132 |
| 4,799,319 | A | * | 1/1989 | Zellweger | 36/2.6 |
| 4,821,431 | A | * | 4/1989 | Rieffel | 36/88 |
| 4,864,738 | A | * | 9/1989 | Horovitz | 36/29 |
| 5,005,575 | A | * | 4/1991 | Geri | 602/3 |
| 5,930,916 | A | | 8/1999 | Connor | |
| D460,852 | S | * | 7/2002 | Daudier | D2/946 |
| 6,502,331 | B2 | * | 1/2003 | Hines | 36/132 |
| 6,532,689 | B1 | | 3/2003 | Jones, Jr. | |
| 7,645,250 | B2 | | 1/2010 | Koby et al. | |
| 7,805,859 | B2 | * | 10/2010 | Finkelstein | 36/44 |
| 2005/0120591 | A1 | * | 6/2005 | Andrew | 36/29 |
| 2006/0010717 | A1 | * | 1/2006 | Finkelstein | 36/25 R |
| 2006/0130363 | A1 | * | 6/2006 | Hottinger | 36/28 |
| 2008/0060221 | A1 | * | 3/2008 | Hottinger | 36/28 |

* cited by examiner

*Primary Examiner* — Marie Patterson
(74) *Attorney, Agent, or Firm* — McKee, Voorhees & Sease, P.L.C.

(57) ABSTRACT

A footwear article that has an insert pad filled with loose particulate material which is configured within the pad to provide the feeling of walking on a sandy beach and with the same massage affect to the foot as walking on a sandy beach. The pad is particularly configured to prevent the loose particulate material inside of it from flowing to the sides of the pad and destroying the massaging affect.

10 Claims, 3 Drawing Sheets

MASSAGING FOOTWEAR

FIELD OF THE INVENTION

This invention relates to footwear having a sole insert designed to provide the same massaging affect as flowing particulate sand underneath bare feet on the beach.

BACKGROUND OF THE INVENTION

The present invention relates to all types of footwear, but especially to slippers which are provided with an inner sole for massaging the underside of the foot. It generally provides the wearer with continuous stimulation of the soles of the feet and has a beneficial affect on the leg and foot muscles of the wearer, particularly as it relates to enhancement of circulation in the lower extremities.

Footwear sole inserts are of course known. See for example, U.S. Pat. No. 2,400,023 to Potter, U.S. Pat. No. 3,922,801 to Zente, U.S. Pat. No. 3,987,559 to Roberts, U.S. Pat. No. 4,567,677 to Zona, U.S. Pat. No. 5,930,916 to Connor, and finally U.S. Pat. No. 6,532,689 to Jones. All of these in one fashion or another relate to footwear with either a sole or sole insert that provides some sort of treatment affect to the bottom of the foot. However, none of these patents disclose a sole insert which stimulates the bottom of the foot in similar fashion to walking in particulate, flowable sand particles on a beach. The latter affect is not easy to achieve with a sole insert since the flow of the particulate particles under influence of the body weight will typically move out from under the weight of the body to the sides, leaving insert a particulate particle distribution that fails in its desired affect.

The result of the above described movement is that the sole insert loses its affect entirely, rendering the footwear useless for its intended purpose. To have an adequate sole insert which does allow correct flow of the particles involves both a combination of selection of the correct particles (not too heavy, such as sand) and the selection of sole inserts which have the correct configuration to prevent undesirable flow characteristics, i.e., smashing of particles to the side.

It is an object of the present invention to provide footwear of a relaxed, refreshed and massaged foot feeling, as when twisting the feet into a dry sand beach.

A further object of the present invention is to provide footwear that mimics the experience of rubbing your feet into dry particulate sand.

A further objective of the present invention is to provide footwear sole inserts having the proper particulate distribution and configuration to give the exhilarated bare foot in the sand feeling and massage affect.

A further objective of the present invention is to provide the above enumerated objectives in an economically feasible manner affordable for various types of footwear.

The method and details necessary to achieve the above objectives will become apparent from the following detailed description of the invention.

SUMMARY OF THE INVENTION

A footwear article that has an insert pad filled with loose particulate material which is configured within the pad to provide the feeling of walking on a sandy beach and with the same massage affect to the foot as walking on a sandy beach. The pad is particularly configured to prevent the loose particulate material inside of it from flowing to the sides of the pad and destroying the massaging affect.

DETAILED DESCRIPTION OF THE PREFERRED EMBODIMENTS

Figure 1:
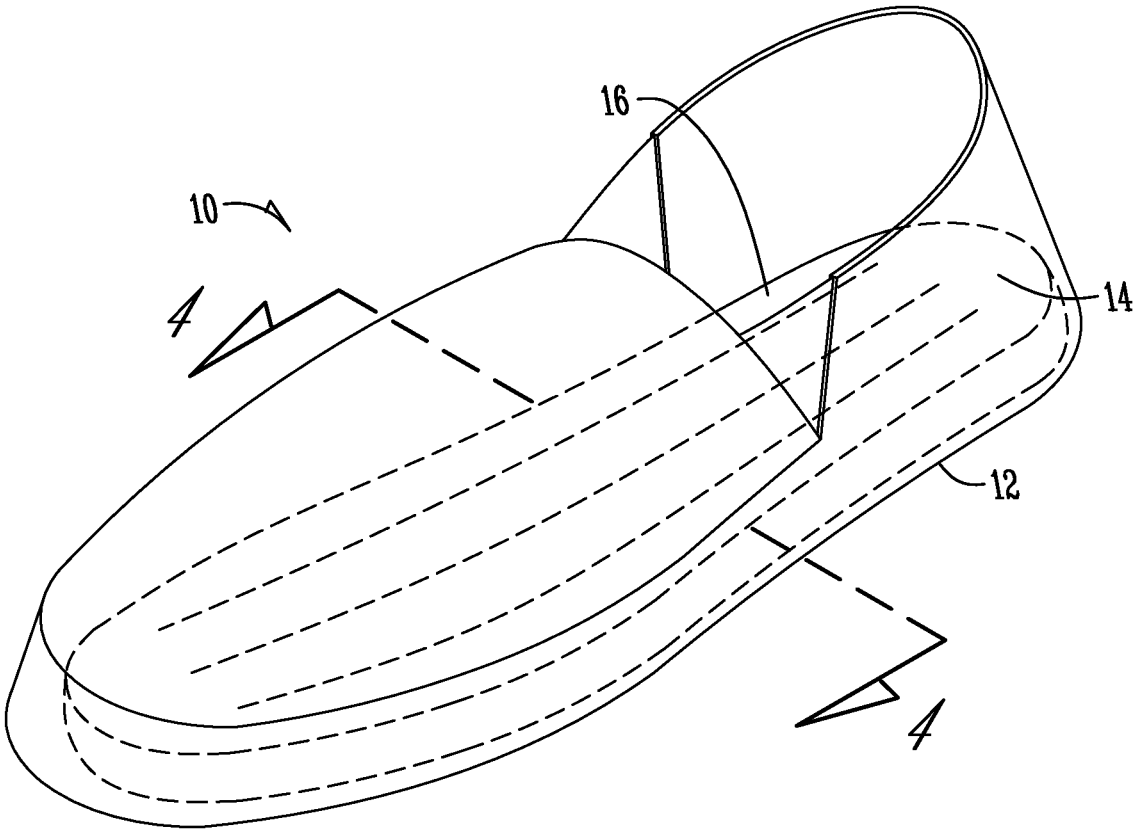
FIG. 1 is a perspective view of exemplary footwear of the present invention.

As heretofore mentioned, the footwear of the present invention can be adapted for a variety of different kinds of footwear and can include, for example, slippers, sandals, shoes, stockings and boots. For convenience and for exemplary purposes only in the present drawings there is shown a slipper. Referring to FIG. 1, it shows a perspective view of the slipper 10 of the present invention. A slipper, as does any other type of footwear, has a sole preferably made of a more durable material than the upper configuration. The sole 12 has an upper portion 14, commonly referred to as the shoe upper, which in the case of a shoe is made of a soft pliable material, as leather. In the case of a slipper, it may be made of a cloth-like material, such as nylon, etc. Upper portion 14 attaches to the sole 12 in conventional sewn manner and the upper above the heel area defines an opening 16 through which the wearer's foot is inserted to provide a tight fit around the user's ankle or leg. The sole 12 has a forward or toe extending portion 18 and an under heel portion 20.

Figure 2:
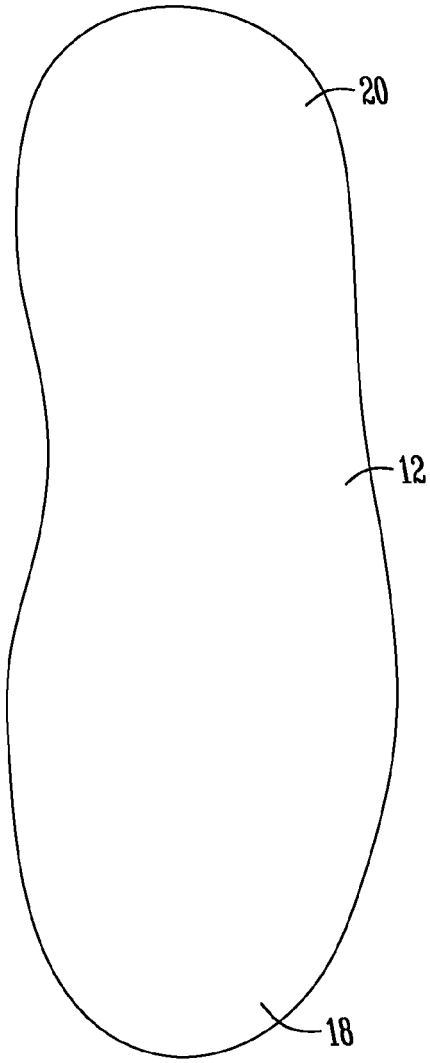
FIG. 2 is a bottom view of exemplary footwear of the present invention.
Figure 3:
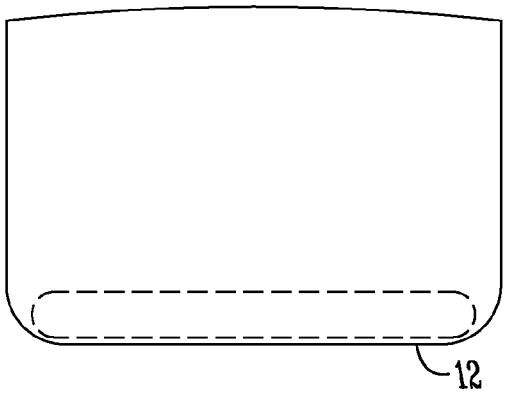
FIG. 3 is a back view of exemplary footwear of the present invention.
Figure 4:
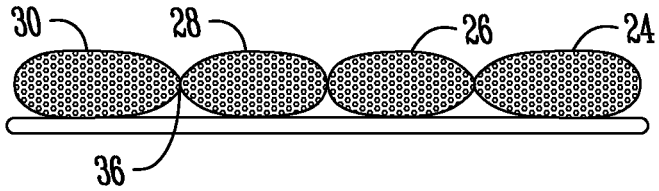
FIG. 4 is a sectional view of the footwear product of FIG. 1 along line 4-4.
Figure 5:
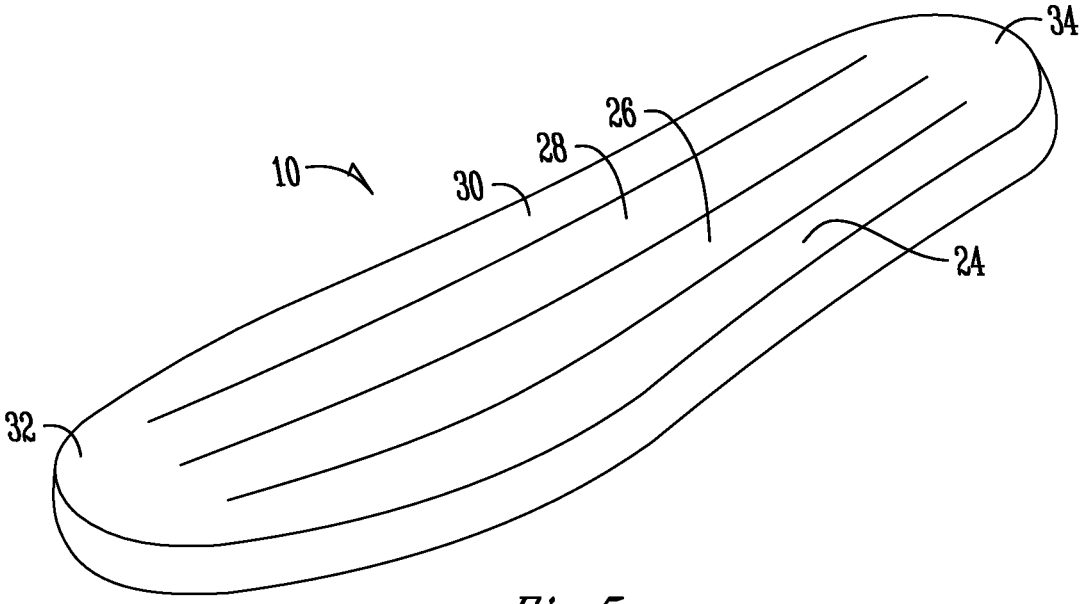
FIG. 5 is a perspective view of one of the inserts of the present invention.
Figure 6:
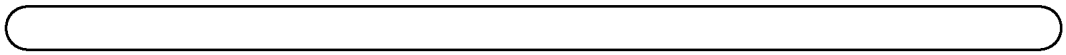
FIG. 6 is a side view of one of the inserts of the present invention.

An insert pad (see FIG. 5) has similar configuration to the sole 12 as seen in FIG. 2. The insert pad 22 is a woven cloth material and may be adhered to the sole 12 or may be a removable insert pad 22, which in most cases is preferred. The insert pad 22 is best illustrated in FIG. 5. There shown, it conforms generally to the same configuration as the sole 12 (see FIGS. 2 and 5). The insert pad 22 has a plurality of generally parallel elongated channels or pockets 24, 26, 28 and 30. These are all illustrated in sectional view in FIG. 4 and in perspective view in FIG. 5. The channels are made by having sewn compartments or pockets as illustrated in FIG. 2. At the end just prior to the terminus of the toe portion 32 and the rearward heel portion 34, the channel communicates so that particles can communicate from one elongated channel or pocket compartment area to another via an exit from one and entrance to another at 32, 34. As hereinafter explained, this configuration as illustrated in FIGS. 4 and 5 particularly is extremely important to the adequate performance of the insert pad 22. Equally important to the adequate performance of the insert pad 22 is the nature of the flowable particulate material that this within insert pad 22 particles 36 are illustrated in the cross-sectional view of FIG. 4.

Referring to FIG. 4, deformable insert pad 22 is formed as described with reference to FIG. 5. This deformable insert pad 22 accommodates a plurality of ergonomically favorable positions. Deformable insert pad 22 is resiliently deformable.

Deformable insert pad 22 is filled with a granular filling material 36 that may be a plurality of small, tightly packed pellets or beads, hereinafter referred to collectively as beads. Beads 36 are shown in the cut-away portion of FIG. 4 that shows filling material 36. Beads 36 may be oval, elliptical, round, disc or egg-shaped, without sharp or rough edges and with a completely smooth exterior. The exemplary beads 36 or other filling material 36 is tightly packed in a corresponding pocket 24, 26, 28 and 30 that forms deformable insert pad 22, to a sufficiently high density so that deformable insert pad 22 is moldable as the beads smoothly redistribute responsive to the underlying structure and the position of the wearer's foot. The packing and configuration may be so as to provide a resiliency to deformable insert pad 22.

Filling material 36 may be tightly packed within the pocket to provide complete and smooth moldability. Filling material 36 may be advantageously formed of thermal storage material capable of maintaining a reduced temperature for an extended period of time. By reduced temperature, it is meant that the temperature of the thermal storage material is lower than that of the ambient environment. The reduced temperature may be a temperature at or below 32° F., a temperature at or below 40° F., or any temperature that is less than room temperature. In one exemplary embodiment, ergoBeads™ may be used as filler material 36. Since filling material 36 is advantageously formed of a population of small beads 36 with tiny air pockets between the beads, it provides a more comfortable soothing cool than the freezing cold sensation such as provided by ice or gel. As opposed to ice which has a temperature of 32° F. or lower, filling material 36 may be maintained at reduced temperatures greater than 32° F. The beads 36 may also be warmed, if desired. Deformable insert pad 22 has a smooth conformal nature that is more comfortable than the lumpy surface of an ice bag which includes sharp or hard edges that may provide pressure points of extreme cold. According to the embodiment in which filling material 36 is a thermal storage material, the thermal storage material may additionally or alternatively be chosen to retain heat and provide soothing warmth. Various thermal storage materials may be used.

Exemplary beads 36 of filling material 36 have smooth exterior surfaces. In an exemplary embodiment, beads 36 may be formed of low density polyethylene ("LDPE") and may be natural or semi-clear white in color. They may be injection molded or extrusion type LDPE particles. Beads 36 are free of sharp edges and include a surface that has an average surface roughness of less than 100 nanometers in one exemplary embodiment enabling the beads to slide easily and freely against each other. The beads' surface may advantageously be polished to enhance smoothness. A coating may optionally be added to filling material 36, in particular coating the surfaces of beads 36. The coating may be a powdery coating formed of a mold-release agent such as an amide, or other materials that provide lubrication. Beads 36 maintain their surface smoothness and the easy deformability of deformable insert pad 22 is retained at a range of suppressed temperatures below 32° F. and on the other end above room temperature.

Exemplary illustrated disc shaped beads 36 may include a pair of opposed round or oval surfaces and a length chosen to be less than or equal to 4.5 millimeters in one exemplary embodiment. Beads 36 may include dimensions of 3 millimeters×4.5 millimeters×2 millimeters and a density of 0.910 to 0.935 grams per cubic centimeter but other sizes and densities may be used in other exemplary embodiments, however. In another exemplary embodiment, beads 36 may include dimensions of about 6 millimeters×4 millimeters×3 millimeters. The exemplary dimensions provided are illustrative but not restrictive of the bead dimensions as other dimensions may be used in other exemplary embodiments. The beads may optionally include at least one dimple. Filler material 36 is packed tightly enough so that deformable insert pad 22 is deformable or moldable as the beads redistribute responsive to contact surfaces and positioning by the wearer. When deformable insert pad 22 is in contact with a wearer, a gentle massaging action is created by filling material 36 when pressure such as a gentle rolling action is applied to the opposed side of deformable insert pad 22.

Important to accomplishing the objectives of the present invention is not only the use of the proper particulate flowable material which may be subjected to either heat or cold and which is not too heavy (like sand is). Equally important, however, is to have the correct insert pad 22. The pad must have a plurality of elongated channels or pockets 24, 26, 28 and 30 to function to prevent the beads 36 from all being squeezed out from underneath the foot towards the sides, eliminating completely the sand feel. The particular configuration for the elongated pocket channels 24, 26, 28 and 30 is such that at the forward end they all communicate under the toe area 32 and similarly they all communicate at the rearward end under the heel at 34. This enhances the opportunity for the massaged, squishy feeling that occurs naturally in the sand. The sewn channels prevent pushing out from under the feet.

Through the use of the insert pads 22, the user can decide what amount of comfort or massage affect is desired and then can use the pads as long as he or she wishes, since inserts are easy to insert into, for example, a slipper.

Although the invention has been described in terms of exemplary embodiments, it is not limited thereto. Rather the appended claims should be construed broadly to include other variance and embodiments of the invention, which may be made by those skilled in the art without departing from the scope and range of equivalence of the present invention.

What is claimed is:

1. A foot wear article comprised of a sole;

an upper attached to the sole which defines a foot opening; and an insert pad that is a series of elongated general parallel pockets, each of which are filled with particulate material to restrict particle flow within the pocket, and each of which has opposing ends in open communication with the ends of others of said pockets so that particulate material may move from one pocket to another, said insert pad fitting on top of the sole to provide the feeling of walking on a sandy beach.

2. The foot wear article of claim 1 where the insert pad is removable.

3. The foot wear article of claim 1 wherein the foot wear insert pad is filled with loose, particulate, beaded material.

4. The foot wear article of claim 1 where in the elongated pockets extend from the heel area forward to the toe area of said insert pad.

5. The foot wear article of claim 1 wherein the foot wear article is selected from the group consisting of a slipper, sandal, shoe, stocking and boot.

6. The foot wear article of claim 5 wherein the article is a slipper.

7. The foot wear article of claim 1 wherein the particulate material is a population of smooth plastic beads.

8. The foot wear article of claim 7 wherein the plastic beads are low density polyethylene.

9. The foot wear article of claim 8 wherein the beads are ergo heads.

10. The foot wear article of claim 9 wherein the ergo beads are covered with a mold release agent.

* * * * *

UNITED STATES PATENT AND TRADEMARK OFFICE

CERTIFICATE OF CORRECTION

PATENT NO. : 8,671,591 B2
APPLICATION NO. : 13/031477
DATED : March 18, 2014
INVENTOR(S) : Ivan E. Brown It is certified that error appears in the above-identified patent and that said Letters Patent is hereby corrected as shown below:

In the Claims

Col. 4, Claim 9, Line 63:
DELETE after ergo "heads".
ADD after ergo --beads--.

Signed and Sealed this
Third Day of June, 2014

Michelle K. Lee

Michelle K. Lee
*Deputy Director of the United States Patent and Trademark Office*